US010281150B2

(12) United States Patent
Zivanovic

(10) Patent No.: US 10,281,150 B2
(45) Date of Patent: May 7, 2019

(54) REFRACTORY CERAMIC LINING BRICK AND CORRESPONDING REFRACTORY CERAMIC LINING

(71) Applicant: REFRACTORY INTELLECTUAL PROPERTY GMBH & CO. KG, Vienna (AT)

(72) Inventor: Bojan Zivanovic, Vienna (AT)

(73) Assignee: REFRACTORY INTELLECTUAL PROPERTY GMBH & Co. KG, Vienna (AT)

( * ) Notice: Subject to any disclaimer, the term of this patent is extended or adjusted under 35 U.S.C. 154(b) by 541 days.

(21) Appl. No.: 14/907,083

(22) PCT Filed: Jun. 23, 2014

(86) PCT No.: PCT/EP2014/063157
§ 371 (c)(1),
(2) Date: Jan. 22, 2016

(87) PCT Pub. No.: WO2015/039778
PCT Pub. Date: Mar. 26, 2015

(65) Prior Publication Data

US 2016/0178281 A1 Jun. 23, 2016

(30) Foreign Application Priority Data

Sep. 20, 2013 (EP) ..... 13185362

(51) Int. Cl.
*F23M 5/02* (2006.01)
*F23M 5/04* (2006.01)
(Continued)

(52) U.S. Cl.
CPC ..... *F23M 5/02* (2013.01); *F23M 5/04* (2013.01); *F27D 1/004* (2013.01); *F27D 1/0009* (2013.01);
(Continued)

(58) Field of Classification Search
CPC .... F23M 5/02; F23M 5/04; F23M 2700/0053; F23M 2700/0056; F27D 1/004; F27D 1/04; F27D 1/0009
See application file for complete search history.

(56) References Cited

U.S. PATENT DOCUMENTS 1,927,909 A * 9/1933 Antill ..... F27D 1/004 52/506.04
1,970,209 A * 8/1934 Weaton ..... F27D 1/04 432/250
(Continued)

FOREIGN PATENT DOCUMENTS

AT 286336 B 12/1970
FR 1265500 A 6/1961
(Continued)

OTHER PUBLICATIONS

International Search Report for App. No. PCT/EP2014/063157 dated Sep. 1, 2014.
JP 6559 (T14), Japan.

*Primary Examiner* — David J Laux
(74) *Attorney, Agent, or Firm* — Ralph E. Jocke; Walker & Jocke

(57) ABSTRACT

The invention relates to a refractory ceramic lining brick and a corresponding ceramic refractory lining.

14 Claims, 4 Drawing Sheets

Figure 1:
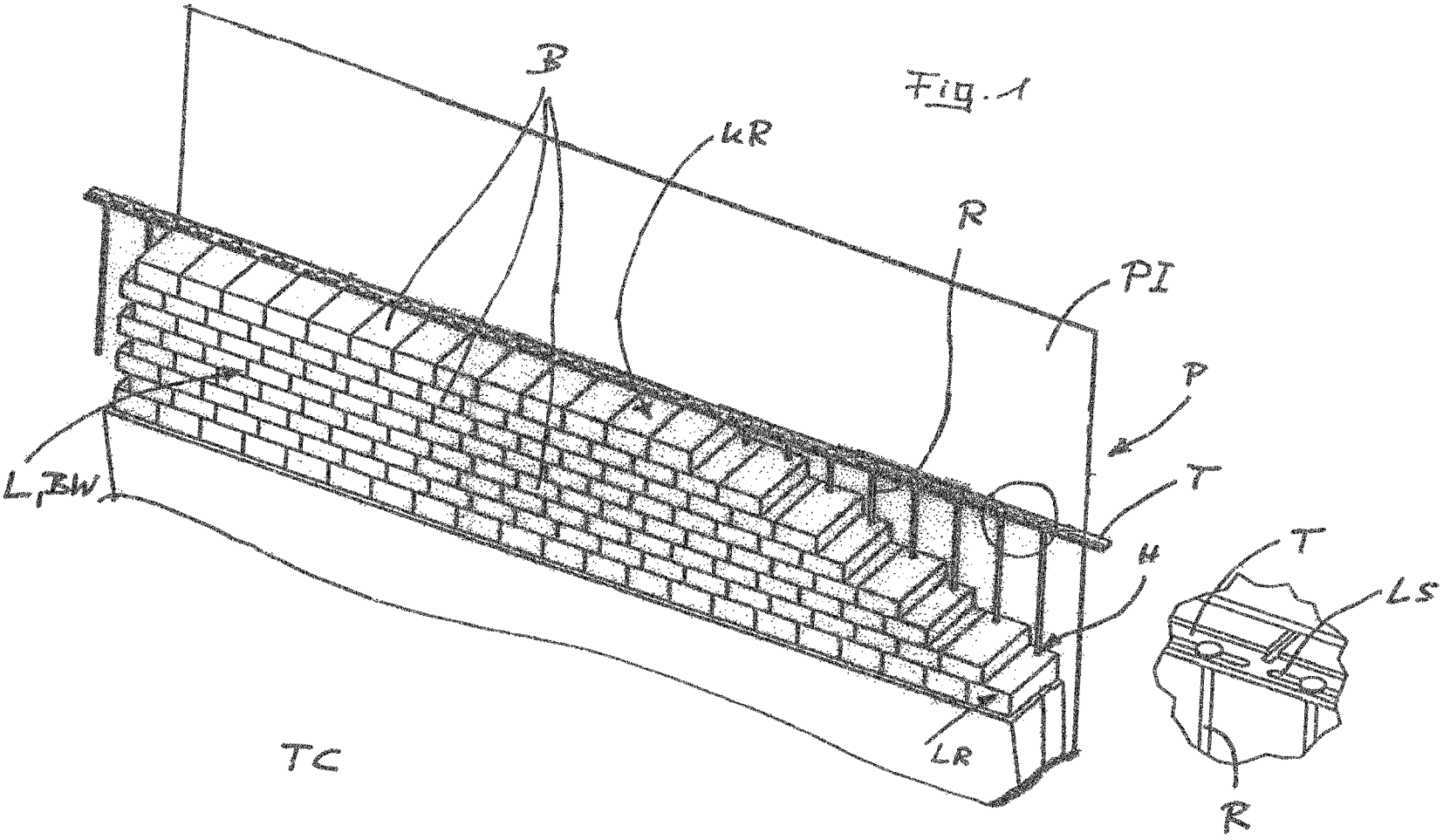

(51) Int. Cl.
*F27D 1/00* (2006.01)
*F27D 1/04* (2006.01)

(52) U.S. Cl.
CPC ..... *F27D 1/04* (2013.01); *F23M 2700/0053* (2013.01)

(56) References Cited

U.S. PATENT DOCUMENTS 2,081,417 A * 5/1937 Antill ..... F27D 1/004 52/506.04
2,144,598 A * 1/1939 Brinckerhoff ..... F23M 5/00 110/336
3,176,433 A * 4/1965 Davies ..... F27D 1/004 52/479
4,453,352 A * 6/1984 Allen ..... F23M 5/02 52/603
5,011,402 A * 4/1991 Hammond ..... F27D 1/004 110/336
5,117,604 A * 6/1992 Bly ..... E04F 13/0835 110/336

FOREIGN PATENT DOCUMENTS

| | | |
|---|---|---|
| GB | 927813 A | 6/1963 |
| JP | S51-133307 | 1/1974 |
| JP | S45-019979 | 4/1974 |
| JP | S49-110705 | 10/1974 |
| JP | 49-79509 | 1/1976 |
| JP | S54-157902 | 11/1979 |
| JP | 61-2913 | 6/1984 |
| JP | 2002-267371 | 9/2002 |
| JP | 2012-052731 | 3/2012 |
| JP | 2012-102978 | 9/2012 |

* cited by examiner

Fig. 4a
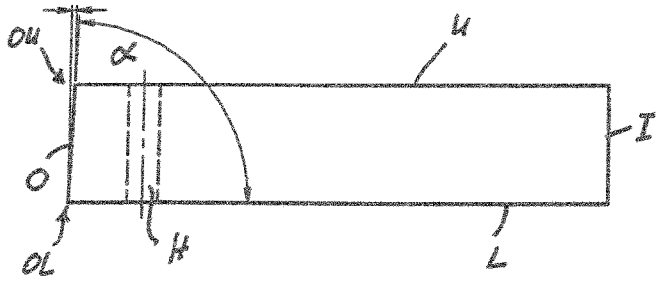
Fig. 4b
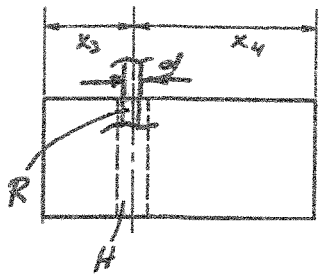
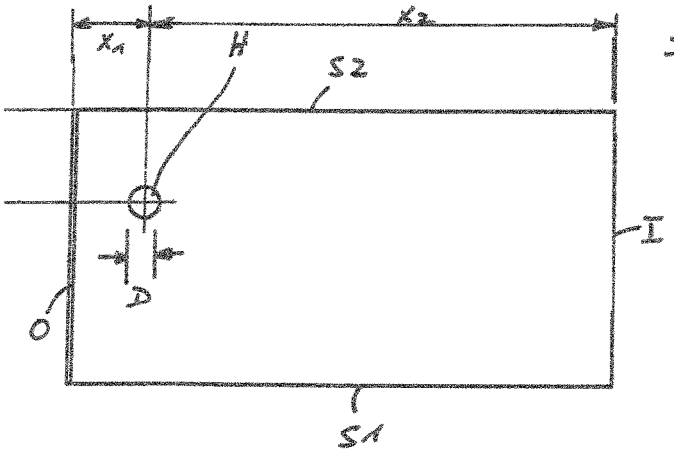
Fig 4c

REFRACTORY CERAMIC LINING BRICK AND CORRESPONDING REFRACTORY CERAMIC LINING

The invention relates to a refractory ceramic lining brick and a corresponding ceramic refractory lining.

Many industrial installations, especially industrial furnaces, high temperature treating vessels, combustion chambers etc. must be lined internally with a corresponding high temperature resistant material, being in most cases a ceramic refractory material, either based on basic ceramics like MgO or non-basic materials like $Al_2O_3$, $ZrO_2$, $TiO_2$ etc.

The most common lining technologies are:

- applying a monolithic ceramic material onto the inner surface of a corresponding outer envelope (casing) of the apparatus to be protected,
- providing a brickwork instead of or together with said monolithic lining.

The invention deals with a refractory lining made of a multiplicity of refractory ceramic lining bricks and at the same time deals with said bricks.

Although lining technologies as mentioned above have proven successful in most cases there is a continuous demand for improvements.

One improvement to be solved is compensation of thermal expansion within the brick and/or brickwork during high temperature applications.

It is well known that there is a more or less significant temperature gradient within a single brick from its inner part (the "hot side", adjacent to the process chamber of the corresponding apparatus) to the outer part (the "cold side") of the brick, adjoining the outer casing of the apparatus. These temperature gradients cause uncontrolled and varying thermal expansions over the brickwork, including the risk of crack formation and excessive wear of the ceramic lining.

This is in particular true with linings and bricks used in an apparatus (vessel), the outer casing of which being cooled (for example water-cooled).

For example in electric arc furnaces (EAF) the upper part of the furnace is typically made of water-cooled panels comprising a refractory lining on its inner surface.

Similar cooling panels or cooling walls are used in combustion chambers, boilers, etc.

It is an object of the invention to provide a brick and a corresponding lining respectively reducing the risk of excessive wear by thermal expansions during high temperature applications.

The invention is based on the idea of a "floating" arrangement of the bricks within the corresponding brickwork. "Floating" means that each brick has a number of degrees of freedom to move without initiating mechanical stresses within the respective brick and/or within the brickwork.

To provide said variances to each brick within the brickwork a lining brick according to the invention is characterized by at least one hole, able to accommodate a fixation means (like a rod) which is inserted into said hole.

Insofar the invention relates—in its most general embodiment—to a refractory ceramic lining brick with

- an upper main surface,
- a lower main surface,
- an inner surface,
- an outer surface,
- two side surfaces,
- all being distinct to each other, characterized by
- at least one hole, extending from the upper main surface to the lower main surface and able to accommodate a fixation rod inserted into said hole.

In other words: contrary to prior art the said bricks are not mortared to each other and thus chemically fixed to each other but arranged within a corresponding brickwork by corresponding rods which penetrate corresponding holes within said bricks.

If such hole is positioned in a part of the brick adjacent to the casing to be protected ("the cold end") then there might be no or just little thermal expansions around said hole in the brick. The cross-section of the hole then might be more or less the same as the cross-section of the corresponding rod or slightly larger.

Generally spoken it is advantageous to provide the brick with a hole that has a cross-section being larger than the cross-section of the corresponding rod to provide a (ring shaped) clearance between said hole and said rod in the mounting state (low temperature application). Said clearance should be large enough to compensate any thermal expansion around said hole/rod to avoid mechanical stresses within the bricks and brickwork and/or to compensate tilting of the brick(s) in other embodiments as further disclosed hereinafter.

To easily assemble brick (hole) and rod one embodiment of the invention provides a brick with a hole which extends perpendicular to at least one of said upper main surface or lower main surface respectively.

This is in particular suitable with bricks wherein the upper main surface and/or the lower main surface being planar. Other brick designs are characterized by side surfaces being planar.

The said hole may be arranged offset between the inner surface (the hot end) and the outer surface (the cold end); in other words: in close vicinity to the casing (envelope) of the apparatus concerned.

In a brickwork with bricks, arranged offset to each other (row by row) the hole should be arranged offset between the two side surfaces to allow the corresponding rod to penetrate a multiplicity of holes of bricks arranged one of the top of the other.

As explained above, the inner brick surface, often being in contact with a hot gas or a hot melt expands much more under said thermal load than the other (outer) "cold end". During corresponding research work it was found that the vertical expansion at the inner end tilts the respective brick. As a consequence the outer surface of the brick changes its orientation. This leads to the following problem:

In case of a cubic brick with six planar surfaces, wherein the outer surface being flush with the inner surface of the casing to be protected tilting of the brick will cause at least the vertically lower end of the outer surface to remove from the said contact position to a remote position. Consequently, the cooling effect by said cooling panels mentioned above is characteristicly reduced.

These disadvantageous are compensated by a brick design wherein the outer surface and the lower surface of the brick provide an interjacent angle smaller than 90°, typically ≤85°, ≤80°, ≤75° and often larger than 45°, ≥50° or ≥55°.

This sloped outer surface enables the brick to pivot (under thermal load at its inner surface) into a position wherein the outer surface now being flush with the inner wall provided by said casing.

In other words: During assembly the outer surface of such brick is at least partially arranged at a certain distance to the corresponding wall section but is tilted under thermal load in a way to compensate any gap between outer brick surface and casing.

As further explained hereinafter a gap may be provided in the "cold state" between the outer surface of the brick(s) and the panel/wall of the apparatus to be lined. This gap, for example with a V-shape in a vertical cross sectional view, may be filled with a material able to compensate any variations of the shape of the gap. It may be a powdery or granular filler material, a viscous material or the like, all of them able to follow changes of the gap shape and characterized by a certain deformability under cold and hot environment. This embodiment with sloped outer surface can be combined with an embodiment in which the cross section of the hole being larger than that of the rod to compensate the tilting effect.

All brick features mentioned above may be realised independently of the general shape of the lining brick. Typically the upper main surface of a brick according to the invention has an overall shape of the group comprising: Square, rectangle, trapezoid, segment of a circle, T, double T, L.

The refractory ceramic lining, made of a multiplicity of refractory ceramic lining bricks of the type mentioned is characterized in its most general embodiment by the feature of an arrangement of said bricks to a brickwork such that each rod may be inserted into and through the holes of vertically adjacent lining bricks.

The said rods may be fixedly secured at their free ends.

The rods may be fixedly secured to a track or beam at least at one of their free ends. Again the connection between rods and track (rail) may be such that a relative movement of the two components is possible to allow compensation of any mechanical stresses. As an example: rods with a circular cross section may be fitted within oval openings in the track. A corresponding embodiment is shown in the attached drawing.

The brickwork may be adjacent to the cooling panel (as described above) with the proviso that the outer surfaces of the bricks being arranged neighbouring said cooling panel.

It follows from the above description of the invention that an advantageous arrangement of the bricks being to provide the said holes close to the "cold end" in the mounted state.

Further features of the invention will become apparent from the sub claims and the other application documents.

The invention will now be described with respect to the attached drawing, which schematically represents one embodiment of the invention, namely in FIG. 1: A three-dimensional view onto a refractory ceramic lining, FIG. 2: A vertical cross-sectional view through part of said lining.

Figure 3:
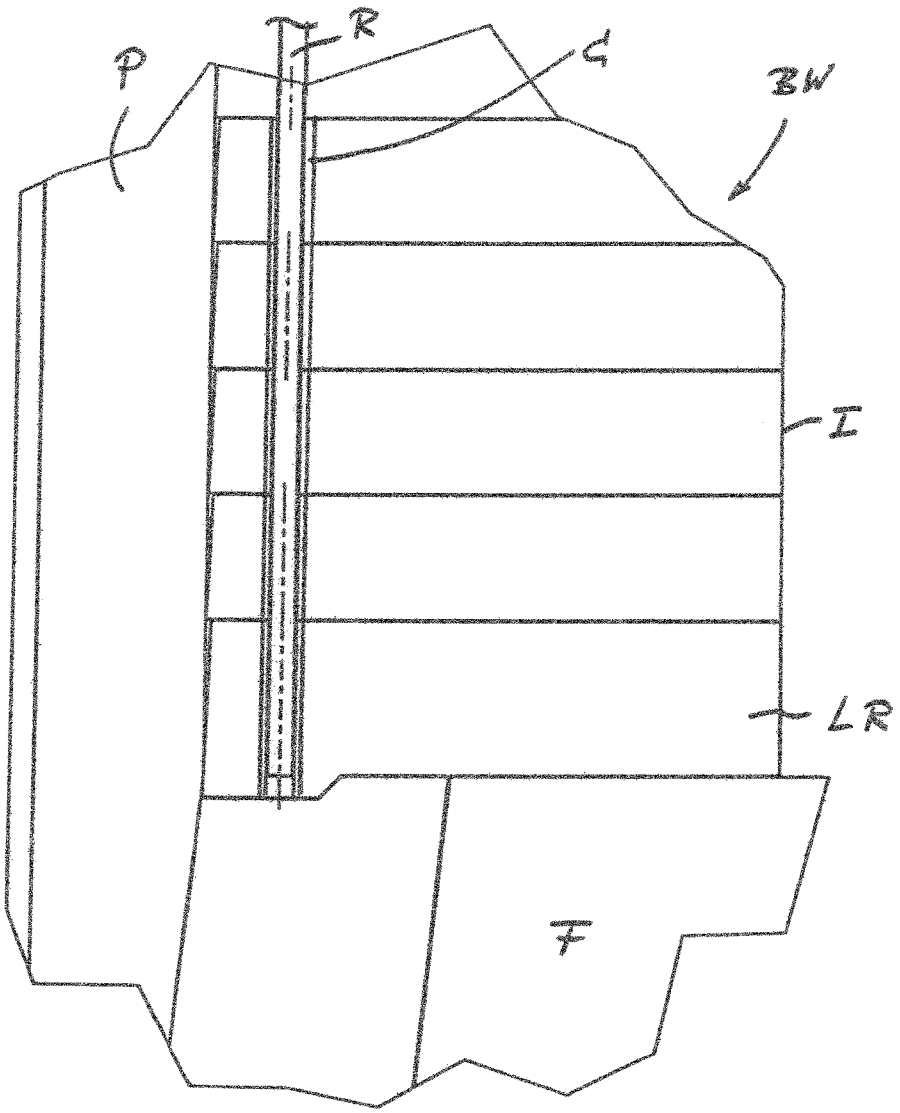

FIG. 3: A cross-sectional view of the lower part of the refractory lining

FIGS. 4*a-c*: A corresponding lining brick in three different views.

FIG. 1 shows a part of a planar outer metal casing, hereinafter called a cooling panel as said casing has a (not disclosed) double wall structure with a cooling fluid like water flowing between the two metal walls.

Said cooling panel P defines an inner wall surface PI which is directed towards a treating chamber TC of a corresponding industrial furnace. In view of the high temperatures (far above 1.000° C.) within said treating chamber TC the metallic cooling panel P is thermally protected by a refractory ceramic lining L, made of a multiplicity of refractory ceramic lining bricks B, wherein said lining bricks B are arranged to a brickwork BW, namely one next to the other in horizontal rows, wherein vertically adjacent rows are offset to each other (FIG. 1).

According to FIG. 4, each brick B comprises an upper main surface U, a lower main surface L, an inner surface I, an outer surface O as well as two side surfaces S1, S2. All of said brick surfaces extend perpendicular to adjacent surface sections except outer surface O as said outer surface O and said lower surface L provide an interjacent angle a of smaller than 90°, namely 87°. It derives from this: When assembling brickwork BW the lower end of OL of the each outer surface O either touches the inner wall surface PI of cooling panel P or being arranged at least closer to said inner wall surface PI than the upper end OU when the said brick B is horizontally aligned with respect to the vertically aligned panel P.

Each brick B comprises one hole H, extending from the upper main surface U to lower main surface L. Said hole H is arranged offset between the inner surface I and the outer surface O (x2>>x1) and offset between the two side surfaces S1, S2 (x4>x3).

This arrangement of hole H allows an overall arrangement of said brickwork BW according to FIG. 1 wherein holes H of bricks B arranged vertically on top of each other are flush to each other so that a common rod R may be inserted into corresponding holes H (FIG. 1).

A larger diameter D of hole H compared with diameter d of rod R allows a clearance C between rod R and hole H and thus a certain maneuverability of each individual brick B in all three directions of the coordinate system.

Rods R are running through all bricks B of said brickwork BW from the upper most row UR to the lower most row LR. While rods R are fixed at the lower end in one of said bricks B they are fixed at their upper end in a corresponding fin (track T) protruding from the inner wall PI of the cooling panel P and equipped with long slots LS to give the rods R the certain maneuverability parallel to cooling panel P.

Figure 2:
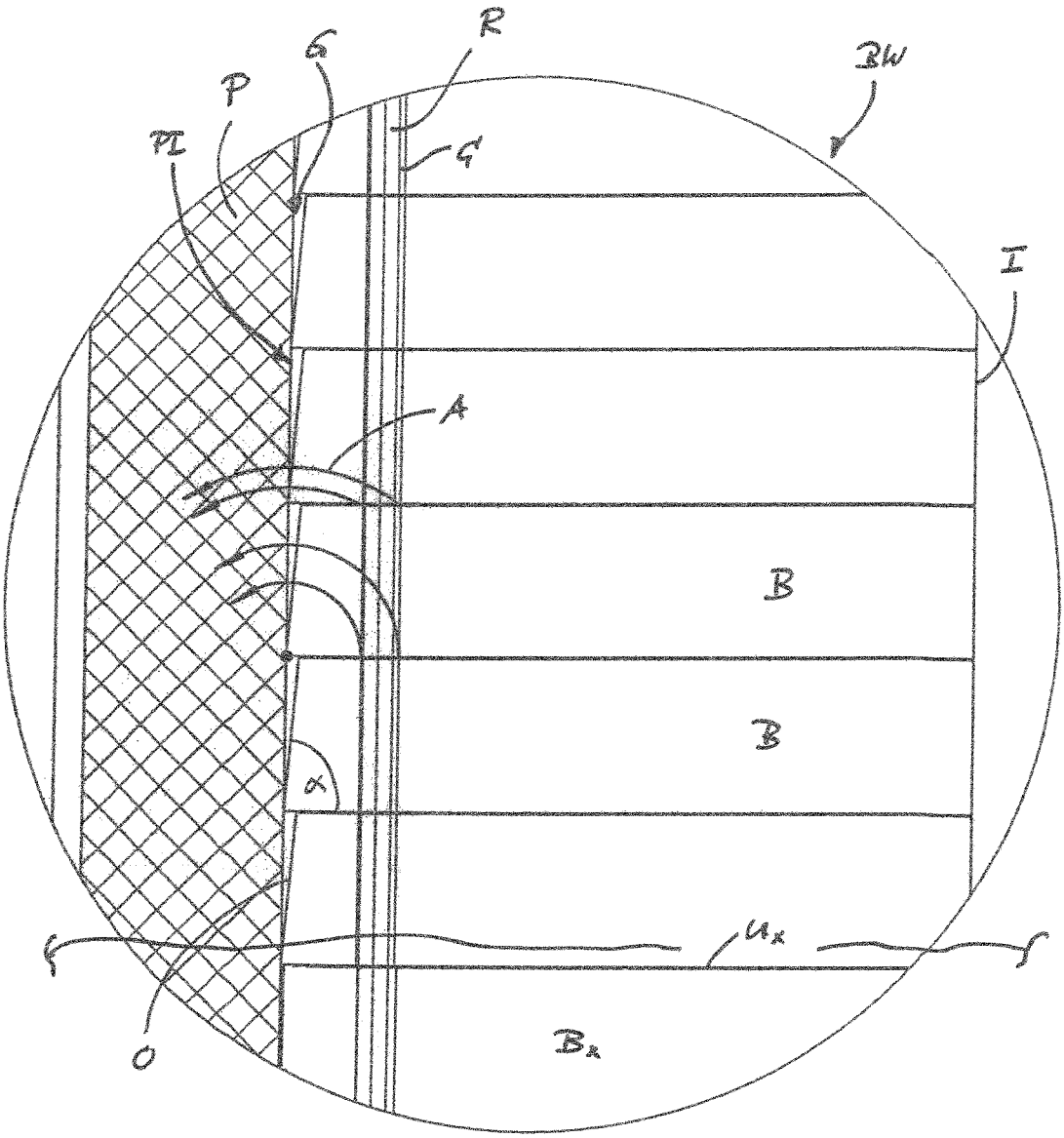

FIG. 2 shows the arrangement of bricks B after a corresponding assembly. Because of the inclination of each outer surface O of each brick B a gap G is provided between said outer surface O and inner wall PI of cooling panel P which gap G has a triangular profile in a cross-sectional view according to FIG. 2.

After the corresponding furnace has been set into its operating state each brick B will be heated up correspondingly with a temperature profile between its inner end (starting from inner surface I) to its outer end (at outer surface O). This is followed by a considerable larger thermal expansion at the inner end ("the hot end") facing treating chamber TC compared with the outer end ("the cold end") facing cooling panel P and, as a consequence, each brick B tends to tilt according to arrows A shown in FIG. 2. Because of clearance C between rod R and hole H such tilting may be achieved without any mechanical stresses in the corresponding brick B. The inclined outer surface O now provides the advantage that, corresponding to the tilting of each brick B, its surface gets closer to the inner wall PI of cooling panel P and thus the cooling effect is increased correspondingly. In FIG. 2 the lower most brick $B_x$ is shown in a position with its outer surface O being in full contact (flush) with inner panel wall PI. Correspondingly its upper surface $U_x$ being arranged in a slidely inclined fashion with its right end (around inner surface I) being higher than its left end (close to outer surface O).

In FIG. 3 a foundation F beneath brickwork BW is schematically represented.

The invention claimed is:

1. Refractory ceramic lining brick (B) comprising:

1.1 an upper main surface (U), 1.2 a lower main surface (L), 1.3 an inner surface (I) configurable in facing relation toward a high temperature treating chamber, 1.4 an outer surface (O) configurable in facing relation away from the treating chamber, 1.5 two side surfaces (S1, S2), all being distinct to each other, 1.6 at least one hole (H) extending from the upper main surface (U) to the lower main surface (L) and able to accommodate a fixation rod (R) inserted into said hole (H) such that the brick is movable in three coordinate directions relative to the rod, 1.7 wherein the outer surface (O) and the lower main surface (L) provide an interjacent angle (α) smaller than 90°.

2. Refractory ceramic lining brick (B) according to claim 1, wherein the hole (H) extends perpendicular to at least one of said upper main surface (U) or lower main surface (L) respectively.

3. Refractory ceramic lining brick (B) according to claim 1, wherein the hole (H) has a cross-section being larger than the cross section of the corresponding rod (R) to provide a clearance (C) between hole (H) and rod (R) in the mounting state.

4. Refractory ceramic lining brick (B) according to claim 1, wherein at least one of the upper main surface (U) , lower main surface (L) or side surfaces (S1, S2) being planar.

5. Refractory ceramic lining brick (B) according to claim 1, wherein the hole (H) is arranged offset between the inner surface (I) and the outer surface (O).

6. Refractory ceramic lining brick (B) according to claim 1, wherein the hole (H) is arranged offset between the two side surfaces (S1, S2).

7. Refractory ceramic lining brick (B) according to claim 1, wherein the outer surface (O) and the lower main surface (L) provide an interjacent angle (α) smaller than 85°.

8. Refractory ceramic lining brick (B) according to claim 1, wherein the outer surface (O) and the lower main surface (L) provide an interjacent angle (α) larger than 75°.

9. Refractory ceramic lining brick (B) according to claim 1, wherein the upper main surface (U) has an overall shape of the group comprising: square, rectangle, trapezoid, segment of a circle, T, double T, L.

10. A refractory ceramic lining (L), made of a multiplicity of refractory ceramic lining bricks (B) according to claim 1, wherein said lining bricks (B) are arranged to a brickwork (BW) such that each rod (R) may be inserted into and through the holes (H) of vertically adjacent lining bricks (B).

11. The refractory ceramic lining (L) according to claim 10, wherein the rods (R) are fixedly secured at their free ends.

12. The refractory ceramic lining (L) according to claim 10, wherein the rods (R) are fixedly secured to a track (T) at least at one of their free ends.

13. The refractory ceramic lining (L) according to claim 12, wherein the rods (R) are fixed to the track (T) with relative movement to each other.

14. The refractory ceramic lining (L) according to claim 10, wherein the brickwork is arranged adjacent to a cooling panel (P) with the proviso that the outer surfaces (O) of said bricks (B) being arranged in facing relation with said cooling panel (P).

* * * * *